US009416515B2

(12) United States Patent
Nicolas

(10) Patent No.: US 9,416,515 B2
(45) Date of Patent: Aug. 16, 2016

(54) DEVICE AND METHOD FOR KEEPING HUMIDITY/WATER AWAY FROM CONCRETE FOUNDATIONS AND PROVIDE INSULATION

(71) Applicant: Marcel Nicolas, Grande-Rivière (CA)

(72) Inventor: Marcel Nicolas, Grande-Rivière (CA)

( * ) Notice: Subject to any disclaimer, the term of this patent is extended or adjusted under 35 U.S.C. 154(b) by 0 days.

(21) Appl. No.: 14/791,366

(22) Filed: Jul. 3, 2015

(65) Prior Publication Data

US 2015/0308066 A1 Oct. 29, 2015

Related U.S. Application Data

(63) Continuation-in-part of application No. 14/063,946, filed on Oct. 25, 2013, now Pat. No. 9,074,335.

(51) Int. Cl.

| | |
|---|---|
| ***E04B 1/00*** | (2006.01) |
| ***E02D 19/00*** | (2006.01) |
| ***E04B 1/70*** | (2006.01) |
| ***E02D 31/00*** | (2006.01) |

(52) U.S. Cl.
CPC ..... *E02D 19/00* (2013.01); *E02D 31/002* (2013.01); *E04B 1/70* (2013.01)

(58) Field of Classification Search
CPC ..... E02D 19/00; E02D 31/002; E04B 1/70
USPC ..... 52/302.1, 302.3, 169.1, 169.2, 169.5, 52/169.14
See application file for complete search history.

(56) References Cited

U.S. PATENT DOCUMENTS

| | | | | |
|---|---|---|---|---|
| 4,572,700 | A * | 2/1986 | Mantarro | E01C 11/225 210/486 |
| 4,704,048 | A * | 11/1987 | Ahlgrimm | E02D 31/02 210/170.07 |
| 5,017,042 | A * | 5/1991 | Minor et al. | 405/50 |
| 5,444,950 | A * | 8/1995 | Kelly et al. | 52/169.5 |
| 5,475,950 | A * | 12/1995 | Palmer | 52/169.5 |
| 5,857,297 | A * | 1/1999 | Sawyer | 52/169.5 |
| 5,916,104 | A * | 6/1999 | Lucenet | E02B 11/00 210/170.07 |
| 6,230,468 | B1 * | 5/2001 | Klaus | 52/741.11 |
| 6,279,275 | B1 * | 8/2001 | Sawyer | 52/169.5 |
| 6,634,144 | B1 * | 10/2003 | Moore et al. | 52/169.5 |
| 7,380,374 | B1 * | 6/2008 | Pratt | 52/169.5 |
| 9,045,874 | B1 * | 6/2015 | Kondas | |
| 2002/0152696 | A1 * | 10/2002 | Ruiz et al. | 52/169.5 |
| 2004/0076474 | A1 * | 4/2004 | Parker | 405/49 |
| 2004/0091320 | A1 * | 5/2004 | Parker | 405/45 |
| 2005/0274295 | A1 * | 12/2005 | Setter et al. | 106/816 |
| 2006/0096186 | A1 * | 5/2006 | Safie | 52/169.5 |
| 2006/0112653 | A1 * | 6/2006 | Hogenson | 52/169.5 |
| 2007/0094952 | A1 * | 5/2007 | Niemczyk | 52/169.5 |
| 2009/0158675 | A1 * | 6/2009 | Sourlis | 52/101 |
| 2011/0302863 | A1 * | 12/2011 | Sourlis | 52/302.1 |
| 2014/0259965 | A1 * | 9/2014 | Marawi et al. | 52/1 |

* cited by examiner

*Primary Examiner* — Mark Wendell
(74) *Attorney, Agent, or Firm* — Equinox IP

(57) ABSTRACT

A device, method and kit for keeping humidity/water away from a concrete foundation and provide insulation. The method comprises providing a plurality of devices comprising a rectangular main body having flat surfaces forming a cavity therein, the main body being configured so as to be stackable horizontally and vertically, and having opposed upper and lower surfaces each comprising a plurality of drainage openings therethrough, and positioning the plurality of devices in contact with the soil-facing surface of the concrete foundation wall such that the lower surfaces of the devices face downward.

17 Claims, 4 Drawing Sheets

DEVICE AND METHOD FOR KEEPING HUMIDITY/WATER AWAY FROM CONCRETE FOUNDATIONS AND PROVIDE INSULATION

CROSS-REFERENCE TO RELATED APPLICATIONS

This application is a continuation-in-part of U.S. patent application Ser. No. 14/063,946 filed on Oct. 25, 2013, which is herein incorporated by reference.

FIELD OF THE INVENTION

The present invention relates to concrete foundations, and more specifically to a device and method for keeping humidity/water away from concrete foundations, such as foundation walls and/or a concrete slab sitting on a footing, and provide insulation.

BACKGROUND OF THE INVENTION

The accumulation of water, and sometimes water pressure, along a foundation wall and/or under a concrete slab of a building can generate major problems to the building structure, without accounting for discomforts the building resident has to deal with. Water along a foundation wall and/or under a concrete slab, usually considered as the basement of the building, causes a high level (higher than normal comfortable level) of moisture, which might eventually dampen/damage sections of the walls and/or floor finishing. Other problems may occur on the concrete foundation itself. All these problems are even more present when there is a positive pressure along the wall and/or under the slab.

Such water can be stagnant and remain along the wall and/or under the slab for extensive periods of time, if not permanently, depending on the soil type. Since there is no real access along the wall and/or under the slab, there is no efficient way to get rid of the above-mentioned problems associated with the presence of water or moisture, other than digging along the wall and/or breaking the slab to access the water drenched soil. Alternatively, some have tried to drain such water by reaching the area from underneath the footing, but this could induce local displacement (collapsing, falling) of the footing, which will generate even more problematic situations to the structure of the building.

Humidity can also reach the concrete slab from the interface between the foundation walls and the footing supporting the walls, with the concrete of the foundation walls not fully adhering to the footing, thereby leaving some interstices for water to reach the slab. Furthermore, since the concrete is known to be porous, it is further easy for water often accumulating at the outer periphery of the footing to slowly flow along the unsealed interface and reach the slab sitting on the inner periphery of the footing.

Commonly, particles are placed especially along the foundation walls to provide adequate drainage, which is a time consuming operation since this must be performed in stages (i.e. by sections of 1 or 2 foot at a time, pouring particles, adjusting a landscape fabric membrane, filling the space between the landscape fabric membrane and the soil, and repeating the process) from the base of the foundation wall up towards the surface. This process is very labor intensive, requires specialized equipment for long durations of time and consequently is very expensive.

Accordingly, there is a need for an improved device and method for keeping humidity away from a foundation wall and/or under a main concrete slab and provide insulation.

SUMMARY OF THE INVENTION

It is therefore a general object of the present invention to provide an improved device and method for keeping humidity/water away from concrete foundations and provide insulation, and more specifically to a device and method for keeping humidity/water away from foundation walls and/or a concrete slab sitting on a footing and provide insulation.

An advantage of the present invention is the reduction in the time and equipment required for the installation of particles along concrete foundations by providing box-like devices having drainage openings and which are filled with particles, the devices being configured to be easily stacked vertically along foundation walls or mosaicked in contact with concrete foundations or pathways.

According to an aspect of the present invention there is provided a method for keeping humidity/water away from a concrete foundation wall and provide insulation, the concrete foundation wall having a soil-facing surface, said method comprising the steps of:

- providing a plurality of devices comprising a rectangular main body having flat surfaces forming a cavity therein, the main body being configured so as to be stackable horizontally and vertically, and having opposed upper and lower surfaces each comprising a plurality of drainage openings therethrough; and
- positioning the plurality of devices in contact with the soil-facing surface of the concrete foundation wall such that the lower surfaces of the devices face downward.

According to another aspect of the present invention there is provided a method as above, further comprising the step of: positioning a plurality of longitudinal spacers in contact with the soil-facing surface of the concrete foundation wall prior to positioning the plurality of devices, the plurality of devices being positioned in contact with the longitudinal spacers.

According to another aspect of the present invention there is provided a device for keeping humidity/water away from a concrete foundation and provide insulation, the concrete foundation having a soil-facing surface, said device comprising:

- a rectangular main body having flat surfaces forming a cavity therein, the main body being configured so as to be stackable horizontally and vertically, and having opposed upper and lower surfaces each comprising a plurality of drainage openings therethrough; and
- a plurality of particles, the particles being located within the cavity and having a diameter larger than the openings' diameter;

wherein positioning a plurality of the devices adjacent the soil-facing surface of the concrete foundation keeps humidity/water away therefrom and provide insulation.

According to a further aspect of the present invention there is provided a kit for keeping humidity/water away from a concrete foundation wall and provide insulation, the concrete foundation having a soil-facing surface, said kit comprising:

- a plurality of devices as above; and
- a plurality of longitudinal spacers;
- wherein positioning a plurality of the longitudinal spacers in contact with the soil-facing surface of the concrete foundation wall and a plurality of the devices in contact with the longitudinal spacers keeps humidity/water away therefrom and provide insulation.

According to a further still aspect of the present invention there is provided a method, device and kit as detailed above, wherein at least one surface of the main body is hinged so as to allow access to the cavity and/or the main body is composed of a biodegradable material and/or the particles are selected from the group consisting of gravel, plastic particles, polymer particles, polystyrene particles and a combination thereof.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiments of the present invention will be herein described for indicative purpose and by no means as of limitation.

Figure 1:
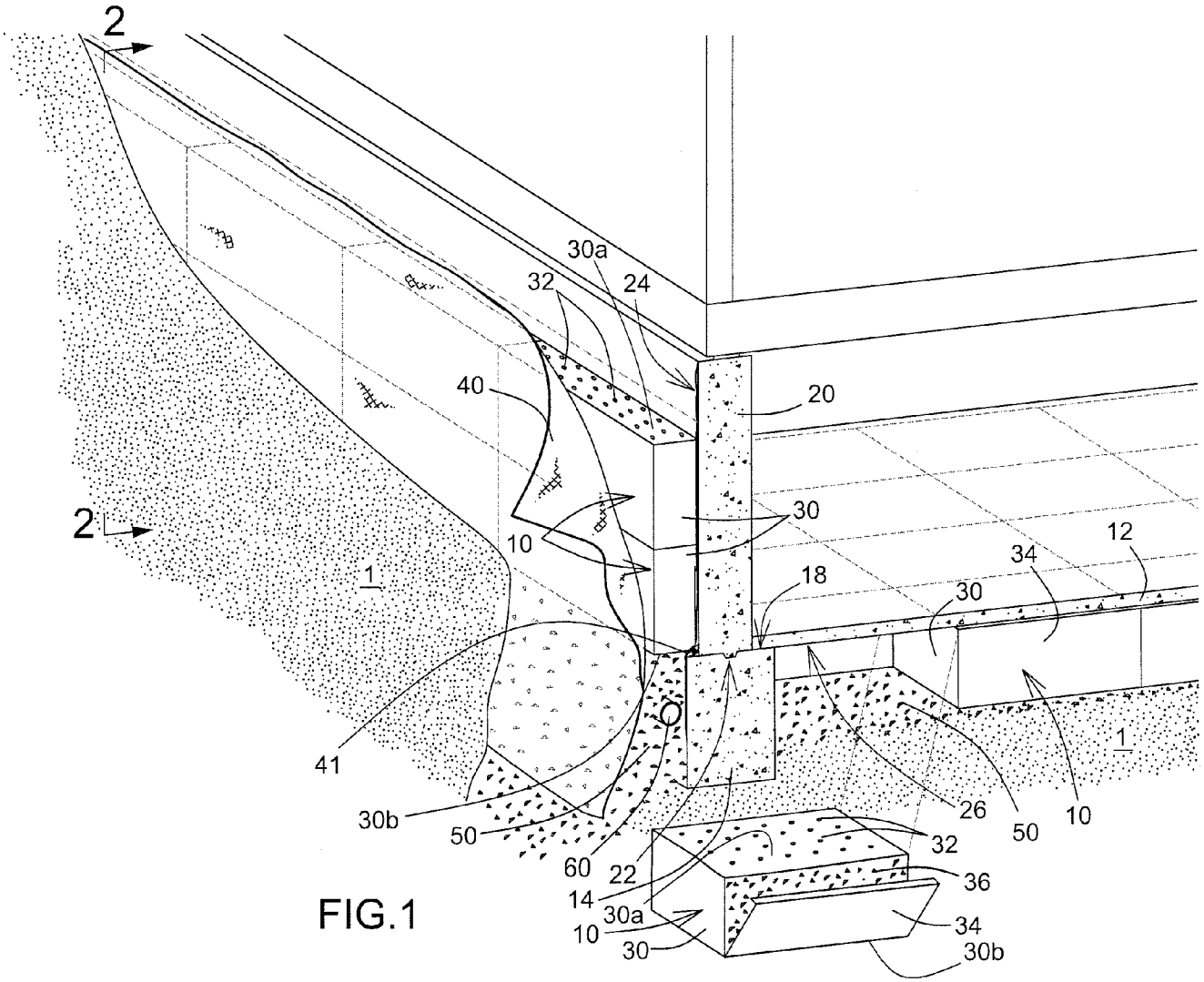
FIG. 1 is a broken perspective view of devices for keeping humidity/water away from concrete foundations and provide insulation in accordance with embodiments of the present invention.
Figure 2:
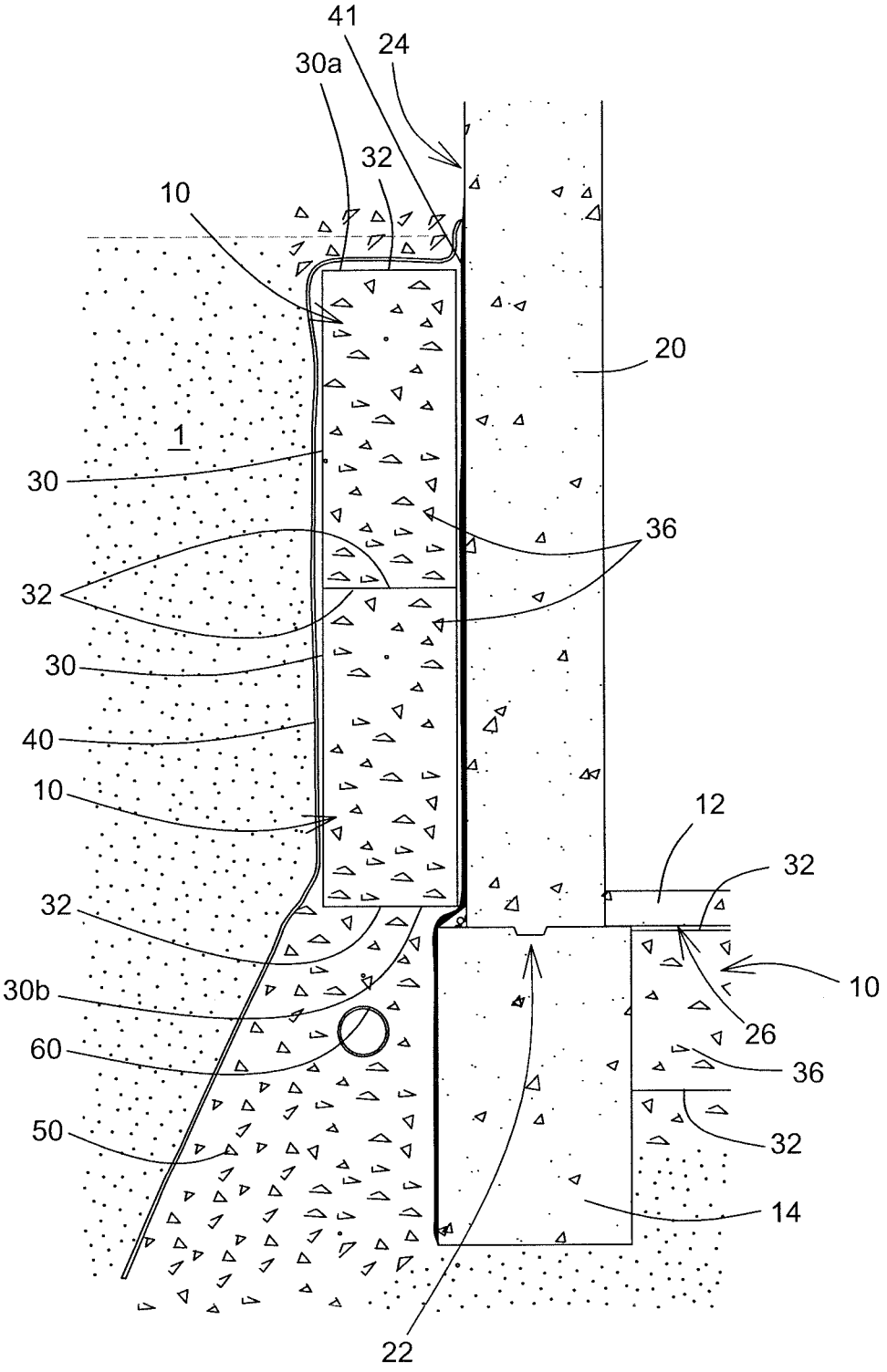
FIG. 2 is an enlarged broken perspective view taken along line 2-2 of FIG. 1.

Referring to FIGS. 1 and 2, there is shown a device 10 for keeping humidity/water away from concrete foundations and provide insulation, more specifically foundation wall 20 and concrete slab 12 partially sitting on a concrete footing 14 of a building in accordance with an embodiment of the present invention. It is to be understood that the device 10 can be used in conjunction with the foundation wall 20 or the concrete slab 12 only as well as with both.

The device 10 is essentially for keeping water/humidity away from the foundation wall 20 entirely sitting on the top surface 18 of the footing 14 and provide insulation to the foundation wall 20, typically with a key 22 at the interface there between to prevent lateral sliding of the foundation wall 20 relative to the footing 14 and/or the main concrete slab 12 partially sitting on an internal edge of a top surface 18 of the footing 14. The foundation wall 20 and slab 12 have respective soil-facing surfaces 24 and 26.

With particular reference to FIG. 1, the device 10 in accordance with the illustrative embodiment is box-like having a rectangular main body formed by flat surfaces 30 made of a bio-degradable material such as for example, cardboard, having opposed upper 30*a* and lower 30*b* surfaces each comprising a plurality of drainage openings 32 therethrough, and a hinged surface 34 allowing access to the interior of device 10, which contains a plurality of non bio-degradable particles 36 such as for example, gravel, plastic particles, polymer particles, polystyrene particles (including Styrofoam™ particles either spherical or "peanut" shaped) or a combination thereof, having a diameter larger than the diameter of the drainage openings 32.

It is to be understood that in alternative embodiments the device 10 may be made of a non bio-degradable material and\or may be provided with further surfaces 30 having drainage openings 32 and\or may be provided with a plurality of hinged surfaces 34 or none at ail. It is further to be understood that the device 10 may be provided empty and the hinged surface 34 used to fill the interior of device 10 with the particles 36 or that it may be provided already filled with the particles 36.

In accordance with the present invention, a plurality of devices 10 are configured to be vertically stacked in a trench between the soil-facing surface 24 of the foundation wall 20 and the soil 1 and horizontally mosaicked in a space between the soil-facing surface 26 of the slab 12 and the soil 1 such that the lower surfaces 30*b*, which comprise drainage openings 32, face downward. The devices 10 are stacked or mosaicked so as to entirely cover the soil-facing surface 24 of the foundation wall 20 or the soil-facing surface 26 of the slab 12, respectively.

As schematically shown in FIG. 1, the present invention is preferably installed along with a bed of small rocks 50 surrounding the footing 14 and having positioned therein a drain pipe 60 to improve the flow of water away from the building.

Typically, a landscape fabric membrane 40 or the like is positioned between the vertically stacked devices 10 and the soil 1. Preferably, the membrane 40, allowing water and other fluids to flow there through while blocking any solid particles to flow there through, extends upward beyond the soil 1 level and downward down to the bed of small rocks 50 surrounding the footing 14. Similarly, in an alternative embodiment, an additional landscape fabric membrane 41 may be positioned between the foundation wall 20 and the vertically stacked devices 10.

The above device 10 can be installed either retroactively onto an existing building or during the construction thereof.

A corresponding method for keeping humidity/water away from concrete foundations and provide insulation, more specifically foundation wall 20 and/or concrete slab 12, is also provided. The method comprises positioning a plurality of devices 10, as previously described, in contact with the soil-facing surface 24, 26 of the foundation wall 20 and concrete slab 12, respectively, such that the lower surfaces of the devices 10 which comprise drainage openings 32 face downward.

Typically, this entails vertically stacking the devices 10 in a trench between the soil-facing surface 24 of the foundation wall 20 and the soil 1 and horizontally mosaicking the devices 10 in a space between the soil-facing surface 26 of the slab 12 and the soil 1 so as to entirely cover the soil-facing surface 24 of the foundation wall 20 or the soil-facing surface 26 of the slab 12, respectively.

Figure 3:
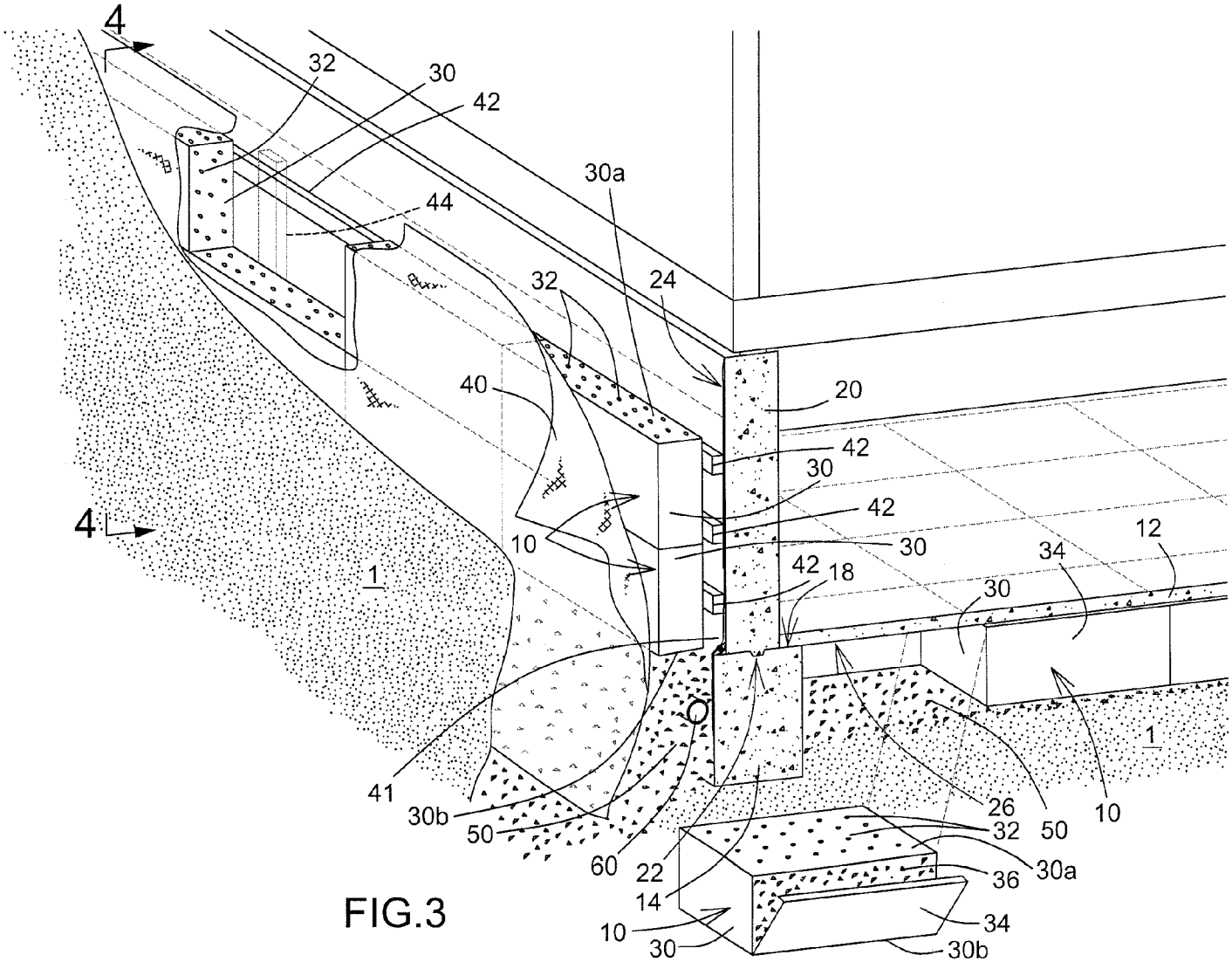
FIG. 3 is a broken perspective view of devices for keeping humidity/water away from concrete foundations and provide insulation in accordance with alternative embodiments of the present invention.
Figure 4:
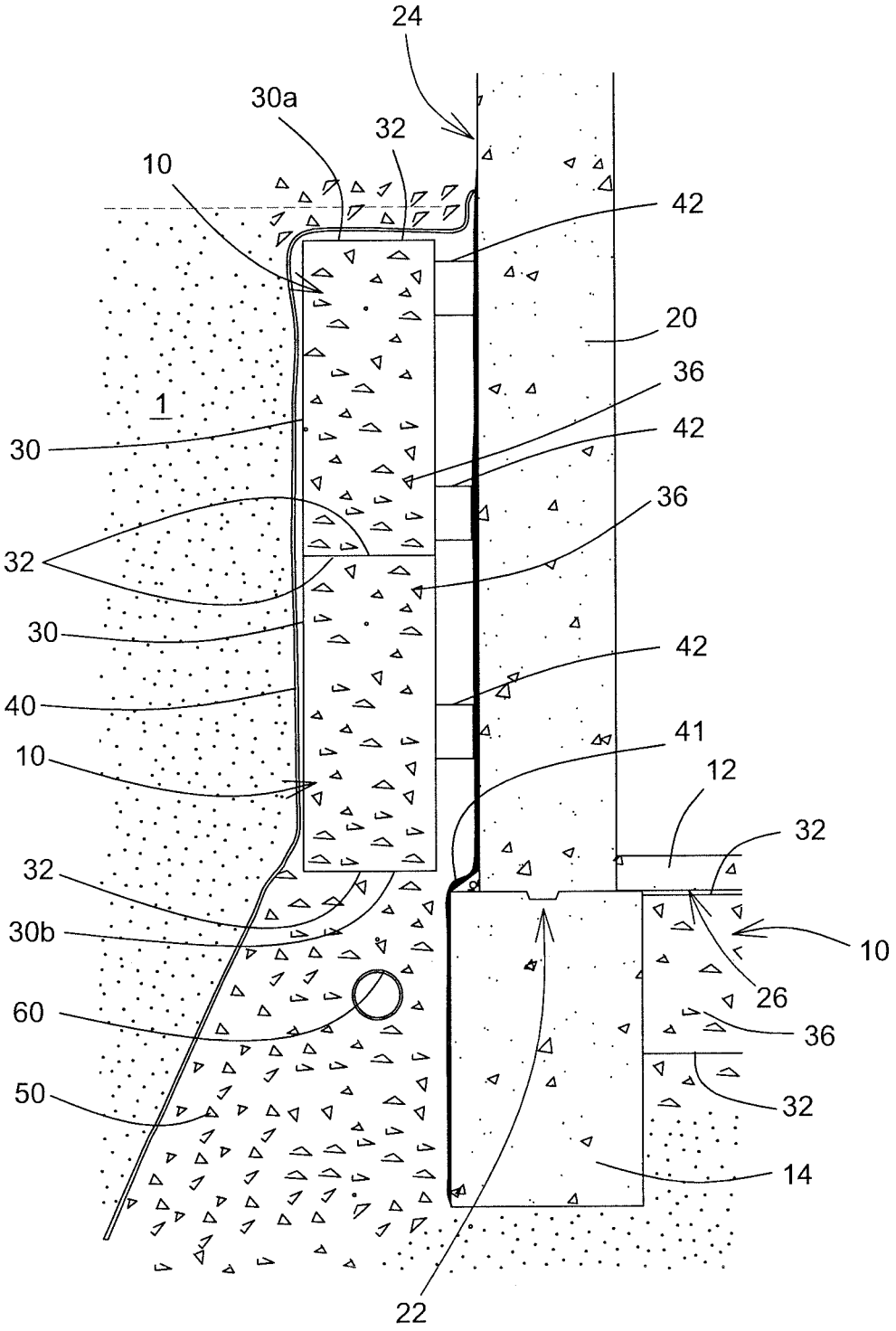
FIG. 4 is an enlarged broken perspective view taken along line 4-4 of FIG. 3.

In accordance with an alternative embodiment of the present invention, shown in FIGS. 3 and 4, a plurality of longitudinal horizontal 42 and/or vertical 44 spacers may be applied at intervals to the soil-facing surface 24, 26 of the foundation wall 20 and/or concrete slab 12, respectively, prior to positioning the plurality of devices 10. The spacers 42, 44 provide for increases water flow away from the foundation wall 20 and/or concrete slab 12 and may be made of, for example, wood, polymer or metal.

It is to be understood that multiple layers of spacers 42, 44 may be used and that additional landscape fabric membranes 41 may be positioned between each spacer 42, 44 layers, or between the spacer 42, 44 and the device 10.

The method typically further includes the step of positioning a landscape fabric membrane 40 between the vertically stacked devices 10 and the soil 1. Similarly, in the alternative embodiment where spacers 42, 44 are used, an additional landscape fabric membrane 41 may be positioned between the foundation wall 20 and the spacers 42, 44 and/or between the spacers 42, 44 and the vertically stacked devices 10.

It is to be understood that multiple layers of spacers 42, 44 may be used and that additional landscape fabric membranes 41 may be positioned between each spacer 42, 44 layers.

The method may also include the steps of excavating the trench previous to the step of vertically stacking the devices 10 along the soil-facing surface 24 the foundation wall 20 and/or providing the space between the soil-facing surface 26 of the slab 12 and the soil 1 previous to positioning the slab 12.

In an alternative embodiment, the method may also apply to keeping humidity/water away from a pathway horizontally mosaicking a plurality of devices 10 horizontally in a trench between a soil-facing surface of the pathway and the soil 1 previous to the positioning of the pathway.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

I claim:

1. A method for keeping humidity/water away from a concrete foundation wall and provide insulation, the concrete foundation wall having a soil-facing surface, said method comprising the steps of:

providing a plurality of devices comprising a rectangular main body having flat surfaces forming a cavity therein encompassing a plurality of particles, the main body being configured so as to be stackable horizontally and vertically, and having opposed upper and lower surfaces each comprising a plurality of drainage openings therethrough, the openings having a diameter smaller than the diameter of the particles;

positioning a plurality of longitudinal spacers at intervals in contact with the soil-facing surface of the concrete foundation wall, the plurality of longitudinal spacers increasing water flow away from the concrete foundation wall; and positioning the plurality of devices in contact with the longitudinal spacers such that the lower surfaces of the devices face downward.

2. The method of claim 1, wherein the step of positioning the plurality of devices includes: stacking the plurality of devices vertically in a trench between the longitudinal spacers in contact with the surface of the foundation wall and the soil.

3. The method of claim 2, further comprising the step of: positioning a landscape fabric membrane in at least one position selected from a group consisting of between the stacked plurality of devices and the soil, between the surface of the foundation wall and the longitudinal spacers and between the longitudinal spacers and the stacked plurality of devices.

4. The method of claim 3, further comprising the step of: excavating the trench previous to the step of positioning the plurality of devices.

5. The method of claim 1, wherein at least one surface of the main body is hinged so as to allow access to the cavity.

6. The method of claim 5, wherein the step of providing a plurality of devices includes:

providing the plurality of devices with empty cavities;

providing the plurality of particles; and filling the cavities with the plurality of particles via the hinged surface.

7. The method of claim 1, wherein the main body is composed of a biodegradable material.

8. The method of claim 1, wherein the particles are selected from the group consisting of gravel, plastic particles, polymer particles, polystyrene particles and a combination thereof.

9. A device for keeping humidity/water away from a concrete foundation and provide insulation, the concrete foundation having a soil-facing surface, said device comprising:

a rectangular main body having flat surfaces forming a cavity therein, the main body being configured so as to be stackable horizontally and vertically, and having opposed upper and lower surfaces each comprising a plurality of drainage openings therethrough, at least one surface of the main body being hinged so as to allow access to the cavity; and a plurality of particles, the particles being located within the cavity and having a diameter larger than the openings' diameter;

wherein positioning a plurality of the devices adjacent the soil-facing surface of the concrete foundation keeps humidity/water away therefrom and provide insulation.

10. The device of claim 9, wherein the particles are selected from the group consisting of gravel, plastic particles, polymer particles, polystyrene particles and a combination thereof.

11. A device for keeping humidity/water away from a concrete foundation and provide insulation, the concrete foundation having a soil-facing surface, said device comprising:

a rectangular main body having flat surfaces forming a cavity therein, the main body being configured so as to be stackable horizontally and vertically, and having opposed upper and lower surfaces each comprising a plurality of drainage openings therethrough, the main body being composed of a biodegradable material; and a plurality of particles, the particles being located within the cavity and having a diameter larger than the openings' diameter;

wherein positioning a plurality of the devices adjacent the soil-facing surface of the concrete foundation keeps humidity/water away therefrom and provide insulation.

12. The device of claim 11, wherein the particles are selected from the group consisting of gravel, plastic particles, polymer particles, polystyrene particles and a combination thereof.

13. A kit for keeping humidity/water away from a concrete foundation wall and provide insulation, the concrete foundation having a soil-facing surface, said kit comprising:

a plurality of devices, each one of said plurality of devices including:

a rectangular main body having flat surfaces forming a cavity therein, the main body being configured so as to be stackable horizontally and vertically, and having opposed upper and lower surfaces each comprising a plurality of drainage openings therethrough; and a plurality of particles, the particles being located within the cavity and having a diameter larger than the openings' diameter; and a plurality of longitudinal spacers;

wherein positioning a plurality of the longitudinal spacers at intervals in contact with the soil-facing surface of the concrete foundation wall and a plurality of the devices in contact with the longitudinal spacers keeps humidity/water away therefrom and provide insulation.

14. The kit of claim 13, further comprising at least one landscape fabric membrane to be positioned in at least one position selected from a group consisting of between a stacked plurality of devices and the soil, between the surface of the foundation wall and the longitudinal spacers and between the longitudinal spacers and the stacked plurality of devices.

15. The kit of claim 13, wherein at least one surface of the main body is hinged so as to allow access to the cavity.

16. The kit of claim 13, wherein the main body is composed of a biodegradable material.

17. The kit of claim 13, wherein the particles are selected from the group consisting of gravel, plastic particles, polymer particles, polystyrene particles and a combination thereof.

* * * * *